US011872432B1

(12) United States Patent
Martin

(10) Patent No.: US 11,872,432 B1
(45) Date of Patent: Jan. 16, 2024

(54) PORTABLE OBLIQUE, ABDOMINAL AND CORE EXERCISING DEVICE

(71) Applicant: Chris Martin, Oxford, AL (US)

(72) Inventor: Chris Martin, Oxford, AL (US)

( * ) Notice: Subject to any disclaimer, the term of this patent is extended or adjusted under 35 U.S.C. 154(b) by 0 days.

(21) Appl. No.: 17/643,806

(22) Filed: Dec. 10, 2021

(51) Int. Cl.

| | |
|---|---|
| ***A63B 21/05*** | (2006.01) |
| ***A63B 21/055*** | (2006.01) |
| ***A63B 21/00*** | (2006.01) |
| ***A63B 21/008*** | (2006.01) |
| ***A63B 21/02*** | (2006.01) |

(52) U.S. Cl.
CPC ..... *A63B 21/0004* (2013.01); *A63B 21/0087* (2013.01); *A63B 21/00192* (2013.01); *A63B 21/023* (2013.01); *A63B 21/05* (2013.01); *A63B 21/055* (2013.01); *A63B 2209/08* (2013.01)

(58) Field of Classification Search
CPC ..... A63B 21/0087; A63B 21/05–0557; A63B 21/004; A63B 21/00192; A63B 21/023–025; A63B 21/0407; A63B 21/0428; A63B 21/055; A63B 21/02; A63B 2209/08
See application file for complete search history.

(56) References Cited

U.S. PATENT DOCUMENTS

| | | | | |
|---|---|---|---|---|
| 4,193,593 | A * | 3/1980 | Wilson | A63B 21/0552 482/122 |
| 5,071,119 | A | 12/1991 | Johnson | |
| 5,913,756 | A | 6/1999 | Glaser | |
| 6,077,205 | A * | 6/2000 | Zarillo | A63B 23/0211 482/121 |
| 6,206,811 | B1 * | 3/2001 | Lat | A63B 21/0004 482/121 |
| 6,712,742 | B2 * | 3/2004 | Suiter | A63B 21/0004 482/148 |
| 7,169,095 | B2 | 1/2007 | Tuller | |
| 7,569,003 | B1 | 8/2009 | Huffman | |
| 9,868,024 | B2 | 1/2018 | Castelluccio | |
| 11,154,740 | B2 * | 10/2021 | Hume | A63B 21/00181 |
| 2007/0027008 | A1 | 2/2007 | Levinson et al. | |
| 2008/0090706 | A1 * | 4/2008 | Boland | A63B 23/0211 482/122 |
| 2021/0060381 | A1 * | 3/2021 | Lalaoua | A63B 21/4035 |

* cited by examiner

*Primary Examiner* — Loan B Jimenez
*Assistant Examiner* — Kathleen M Fisk
(74) *Attorney, Agent, or Firm* — QuickPatents; Kevin Prince

(57) ABSTRACT

An exercise device comprising an outer tube having a first end and an open second end. An inner tube has a first end fitting inside the open second end of the outer tube. Thus, the inner tube can slide inside the outer tube. Typically, from about 5 percent to about 30 percent of the inner tube will be inside the outer tube when the device is at rest (that is, no force is applied). When the user applies a force to the first end of the outer tube, the inner tube can slide inside the outer tube against force provided by a resistance device. Depending on the force applied, the inner tube can be inserted from about 10 percent to about 100 percent of its length inside the outer tube. The resistance device can be a spring, an elastic cord, magnetic repulsion, or the like.

12 Claims, 9 Drawing Sheets

PORTABLE OBLIQUE, ABDOMINAL AND CORE EXERCISING DEVICE

FIELD OF THE INVENTION

This invention relates to exercise devices, and more particularly to an exercise device that allows the user to work different muscles depending on the angle of the device to the person's body.

BACKGROUND

Exercise equipment of all shapes and sizes has evolved to meet the needs of both gym and home use. Most people are interested in improving their physical condition. However, not everyone wants to spend the extra money for a gym membership.

Performing exercises can be very painful even for people who are in good physical shape. More specifically, sit-ups were first performed while lying on the ground. This technique works, but it puts a strain and pain on the person's lower back and neck. Likewise, some conventional devices also put a severe strain in the same areas.

Therefore, there is a need for a device that can strengthen a person's muscles, especially their side and abdominal muscles, while reducing or eliminating the pain associated with conventional exercise techniques, such as pain and discomfort that may be felt by laying supine for sit-ups. The present invention accomplishes these objectives.

SUMMARY OF THE INVENTION

The present device is an exercise device comprising an outer tube having a first end and an open second end. An inner tube has a first end fitting inside the open second end of the outer tube. Thus, the inner tube can slide inside the outer tube. Typically, from about 5 percent to about 30 percent of the inner tube will be inside the outer tube when the device is at rest (that is, no force is applied). When the user applies a force to the first end of the outer tube, the inner tube can slide inside the outer tube against force provided by a resistance device. Depending on the force applied, the inner tube can be inserted from about 10 percent to about 100 percent of its length inside the outer tube. The resistance device can be a spring, an elastic cord, magnetic repulsion, or the like.

In some embodiments, the exercise device further includes a slot formed along a portion of the inner tube, the slot communicating an inside region of the inner tube with an exterior thereof. A notch is formed in the open second end of the outer tube. An elastic cord is secured to the first end of the inner tube and to the slot, the elastic cord runs inside the inner tube along at least the first end thereof, the elastic cord extending outward through the slot to terminate at the notch. The notch has an opening formed in the open second end of the outer tube and a notch diameter larger than a width of the opening. A thickness of the elastic cord is equal to or smaller than the opening, wherein the elastic cord is operable to be pushed through the opening into the notch. The elastic cord includes a first expanded thickness region at a first end of the elastic cord. The first end of the elastic cord is secured to the notch, wherein the first expanded thickness region prevents the elastic cord from being pulled through the notch diameter of the notch. The elastic cord includes a second expanded thickness region operable to secure the elastic cord to the first end of the inner tube.

Embodiments of the present invention can allow more users the ability to achieve their desired goals of focusing attention on the stomach muscles without the pain of lying on their back. By changing the orientation of the product to the person's body, a person can focus on different muscles. In some embodiments, the apparatus of the present invention can focus strengthening the front and side abdominal muscles of the user, however many other muscles are involved and a strong core can be developed from its use.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements but can also mean a singular element.

Figure 1:
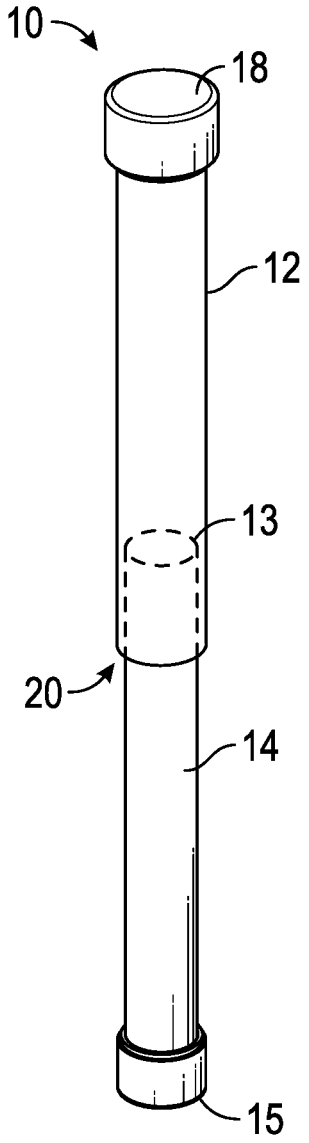
FIG. 1 is a front view of an exercise device, in its expanded state, according to an exemplary embodiment of the present invention.
Figure 2:
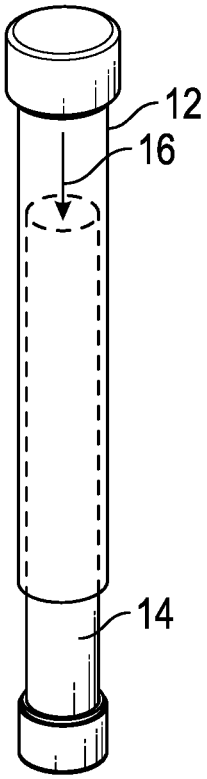
FIG. 2 is a front view of the exercise device of FIG. 1, in a compressed state.

Referring to the FIGS. 1, an exercise device 10 comprises an outer tube 12 having a first end 18 and an open second end 20. An inner tube 14 has a first end fitting inside the open second end 20 of the outer tube 12. Thus, the inner tube 14 can slide inside the outer tube 12. Typically, from about 5 percent to about 30 percent of the inner tube 14 will be inside the outer tube 12 when the device 10 is at rest (that is, no force is applied). When the user applied a force to the first end 18 of the outer tube 12, the inner tube 14 can slide inside the outer tube 12 against force 16 provided by a resistance device. Depending on the force applied the inner tube 14 can be inserted from about 10 percent to about 100 percent of its length inside the outer tube 12.

Figure 3A:
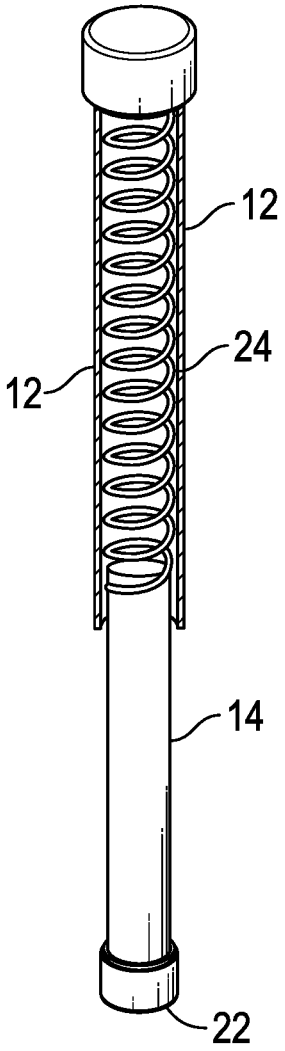
FIG. 3A is a partially cut-away front view of a spring used to supply a force resistive to compression of the device, according to an exemplary embodiment of the present invention.
Figure 3B:
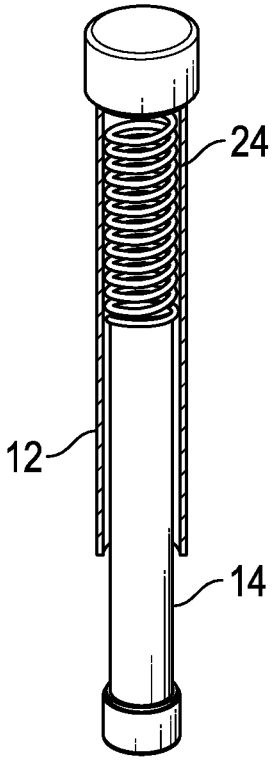
FIG. 3B is a partially cut-away front view of the spring-compression device of FIG. 3, in a compressed state.

In some embodiments, as shown in FIGS. 3A and 3B, the resistance to compression can be provided by a spring 24 resiliently compressible when the inner tube 14 is slid inside the outer tube 12.

Figure 5A:
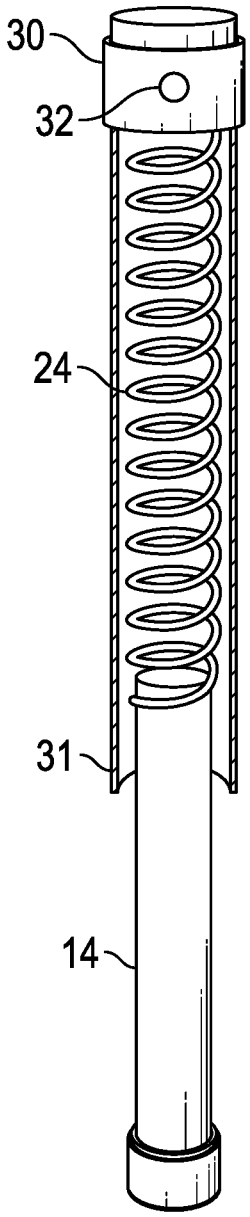
FIG. 5A is a partially cut-away front view of a spring-compression device usable with a controlled air exit device, according to an exemplary embodiment of the present invention.
Figure 5B:
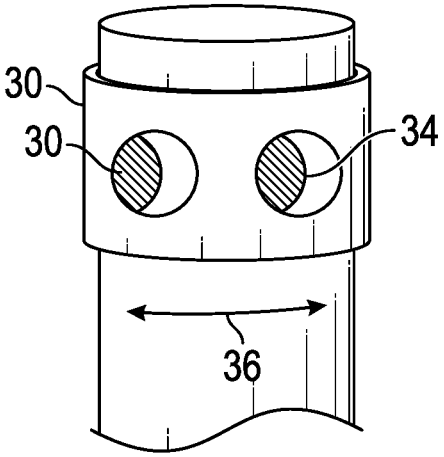
FIG. 5B is a detailed view of an air exit control valve used in the device of FIG. 5A.

In some embodiments, as shown in FIGS. 5A and 5B, a user-adjustable controlled air bleed 30 is provided to release air from between the first end 13 of the inner tube 14 and the first end 18 of the outer tube 12. The air bleed 30 can be turned, as illustrated by arrows 36, to open or close holes 34 to control the speed at which air can exit, thus provided a dampening of the movement of the exercise device 10. A seal 31 may be provided between the tubes 12, 14 to prevent inadvertent air escape at this location.

Figure 4:
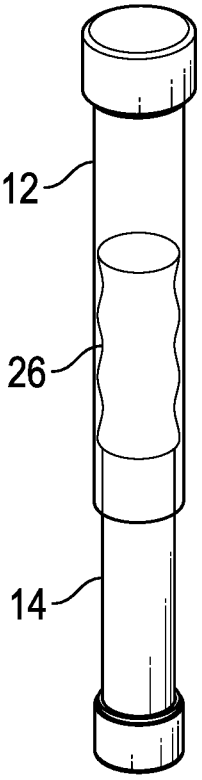
FIG. 4 is a partially cut-away front view of an elastic material disposed between the upper member and the lower member to provide a compressive resistive force, according to an exemplary embodiment of the present invention.

In some embodiments, as shown in FIG. 4, an elastic material 26 can be disposed between the inner tube 14 and the outer tube 12, the elastic material 26 providing resistance to moving the inner tube 14 inside the outer tube 12.

Figure 6:
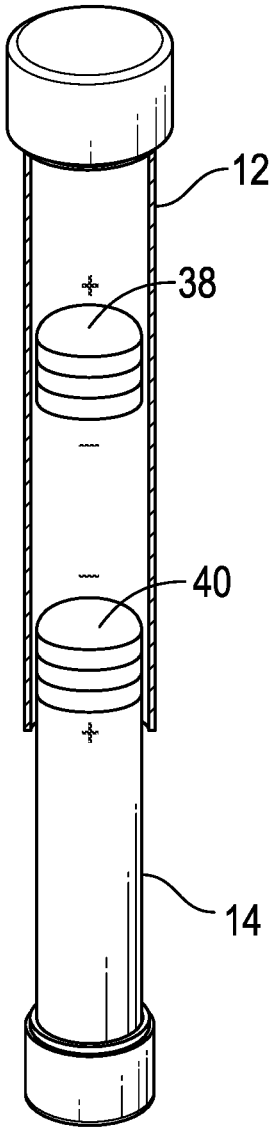
FIG. 6 is a partially cut-away view of a magnetic system for providing a compressive resistive force, according to an exemplary embodiment of the present invention.

In some embodiments, as shown in FIG. 6, a magnetic material providing a magnetic repulsion poles 38, 40 to the inner tube 14 as it is slid inside the outer tube 12.

Figure 9A:
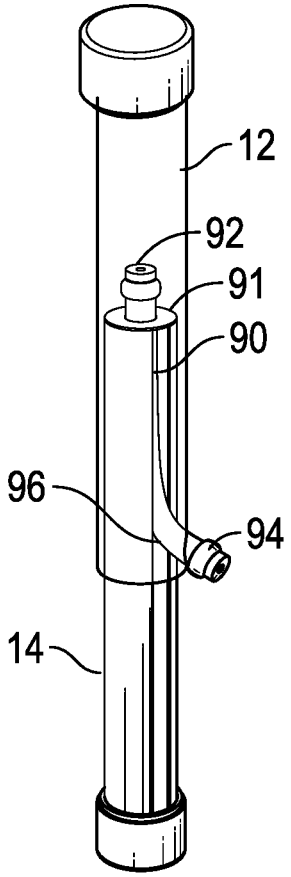
FIG. 9A is a partially cut away view of an exercise device using a resilient cord for compressive resistive force, according to an exemplary embodiment of the present invention.
Figure 9B:
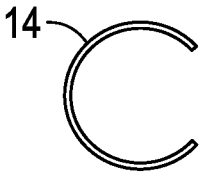
FIGS. 9B through 9E illustrate various cross-sectional shapes of an inner tube member of the exercise device of FIG. 9A.
Figure 9C:
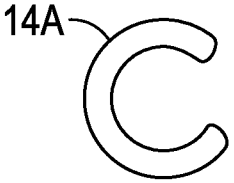
Figure 9D:
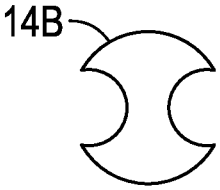
Figure 9E:
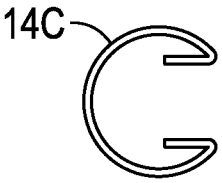

In some embodiments, a slot 98 can be formed along a portion of the inner tube 14, the slot communicating an inside region 99 of the inner tube 14 with an exterior thereof. The slot 98 may terminate at an end closure 22. In some embodiments, a notch 96 can be formed in the open second end 20 of the outer tube 12. The resistive force can be supplied by an elastic cord 90 secured to the first end 13 of the inner tube 14 and to the slot 98 of the outer tube 12. The elastic cord 90 can run inside the inner tube 14 along at least the first end thereof, the elastic cord 90 can extend outward through the slot 98 to terminate at the notch 96. Such a configuration is illustrated in FIG. 9A, for example.

In some embodiments, the notch 96 can have an opening 102 formed in the open second end 20 of the outer tube 12 and a notch diameter 104 larger than a width of the opening 102. The thickness of the elastic cord 90 can be equal to or smaller than the width of the opening 102, wherein the elastic cord 90 is operable to be pushed through the opening (102) into the notch 96.

The elastic cord 90 can include a first expanded thickness region 94 at a first end of the elastic cord 90, the first end of the elastic cord 90 is configured to be secured to the notch 96, wherein the first expanded thickness region 94 prevents the elastic cord 90 from being pulled through the notch diameter 104 of the notch 96. The elastic cord 90 can include a second expanded thickness region 92 operable to secure the elastic cord 90 to the first end 13 of the inner tube 14. The elastic cord 90 can be secured to the first end 13 of the inner tube 14, with a retaining ring 91 having an opening permitting the elastic cord to move therethrough while preventing the second expanded thickness region to move therethrough.

The elastic cord 90 can be any resiliently expandable material, such as bungee, rubber, or the like. In some embodiments, multiple elastic cords may be bundled together to create the elastic cord 90. The material may be selected depending on the amount of resistance desired by the user. Through the design described herein, the user may be able to change the elastic cord to adjust the resistance provided in their exercise routine.

Figure 7:
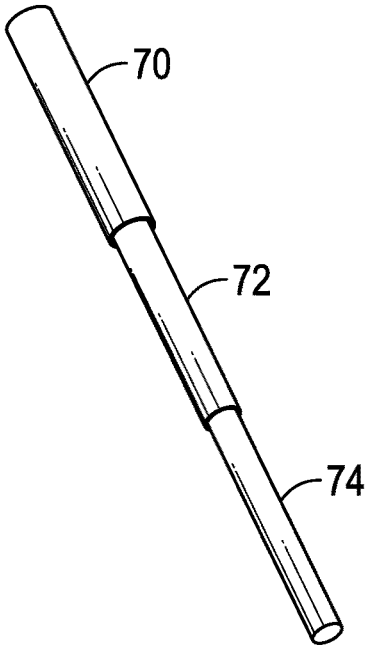
FIG. 7 is a device that can include three sections, each compressible inside each other, according to an exemplary embodiment of the present invention.
Figure 8:
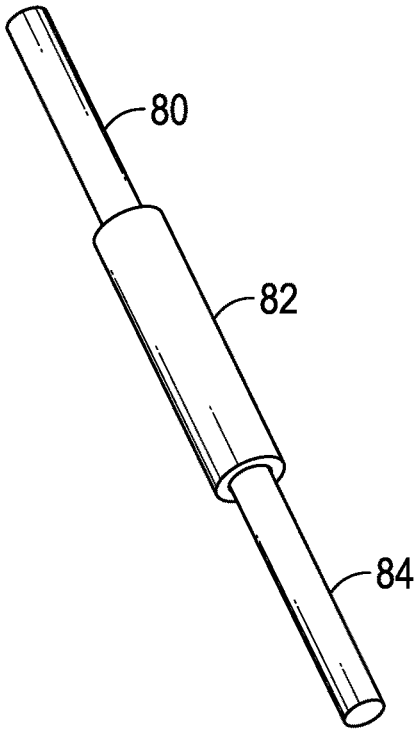
FIG. 8 is another device that can include three sections, each compressible inside each other, according to an exemplary embodiment of the present invention.

In some embodiments, as shown in FIG. 8, a second inner tube 80 can be resiliently slidable into the first end 18 of the outer tube 82. In other embodiments, as shown in FIG. 7, an intermediate tube 72 may be slidable with an outer tube 70 and an inner tube 74. With three or more slidable tubes, as shown in FIGS. 7 and 8, the resistance between the tube may be the same or different. For example, tube 70 may slide with respect to tube 72 at a first force, while tube 72 may slide with respect to tube 74 at a second force. Thus, two different resistances may be felt by the user during compressing of the exercise device.

As shown in FIGS. 9B through 9E, the inner tube can have various cross-sectional geometries, shown by inner tubes 14, 14A, 14B, 14C. In some embodiments, such as with the geometry of inner tube 14B shown in FIG. 9D, two cords may be used, with one in each slot of the inner tube.

Figure 10:
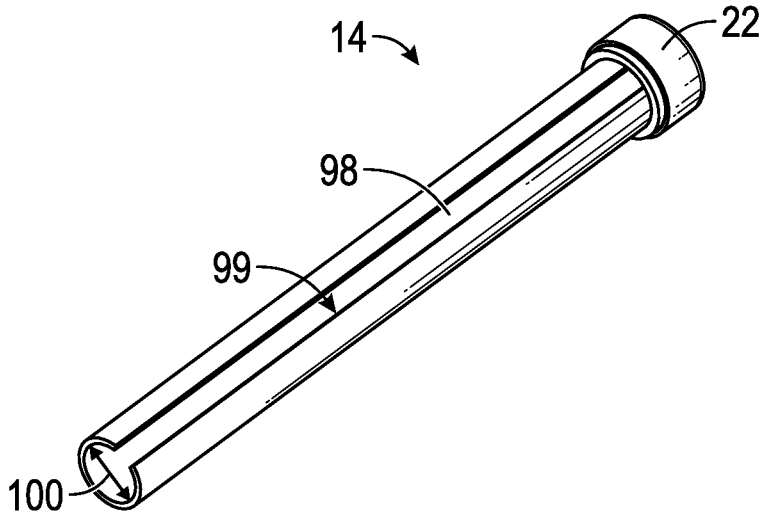
FIG. 10 is a perspective view of the inner member of the exercise device of FIG. 9A.
Figure 11:
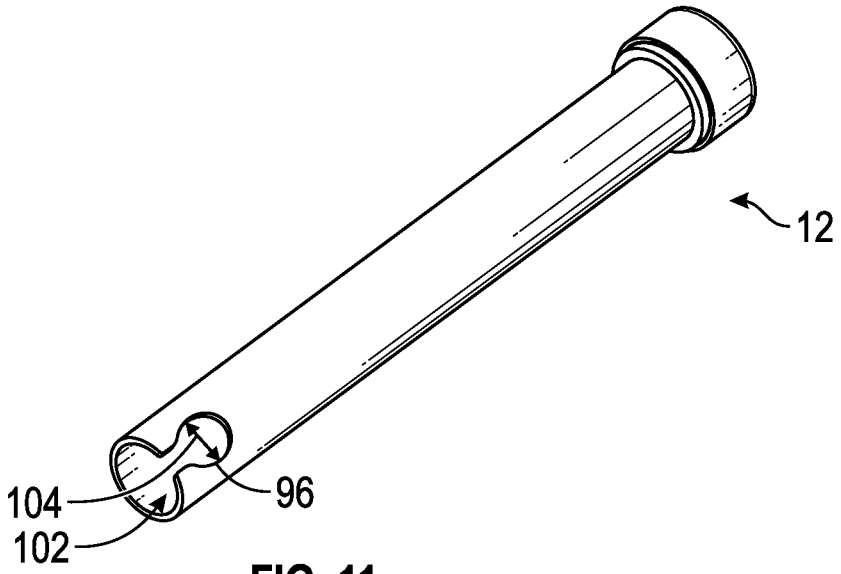
FIG. 11 is a perspective view of the outer member of the exercise device of FIG. 9A.
Figure 12:
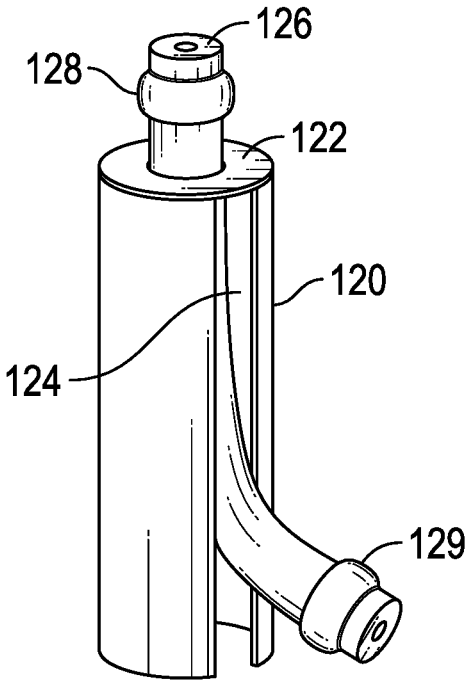
FIG. 12 is a detailed perspective view of a cord engaging with an end of the inner member, according to an exemplary embodiment of the present invention.

In some embodiments, as shown in FIG. 12, an end cap 122 may be disposed at the end of inner tube 120. A cord 126 may extend through an opening in the end cap 122. The cord 126 can be prevented from being pulled through the opening in the end cap 122 through an expanded thickness region 128. The expanded thickness region 128 may be achieved with a device placed on the cord, or by tying the cord in a knot, for example. A similar expanded thickness region 129 can be provided at the opposite end of the cord. In an alternate embodiment, as shown in FIG. 10, the end cap 122 can not be used, but, instead, the expanded thickness region may be larger than an inside diameter 100 of the inner tube 14. Either way, the end of the cord is preventing from being pulled away from the end of the inner tube 14.

Figure 13:
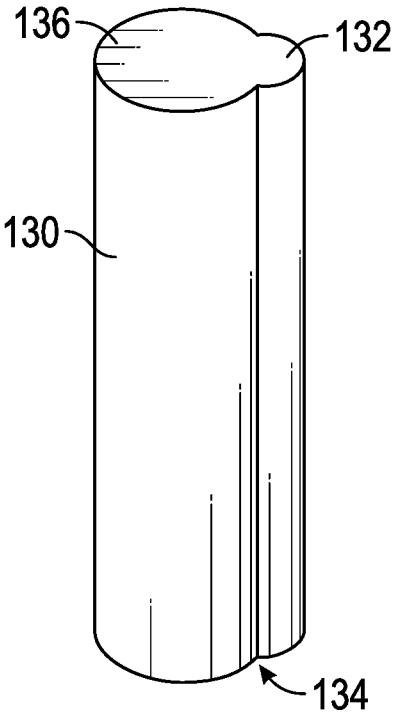
FIG. 13 illustrates an alternate exterior shape of an outer member according to an exemplary embodiment of the present invention.
Figure 14:
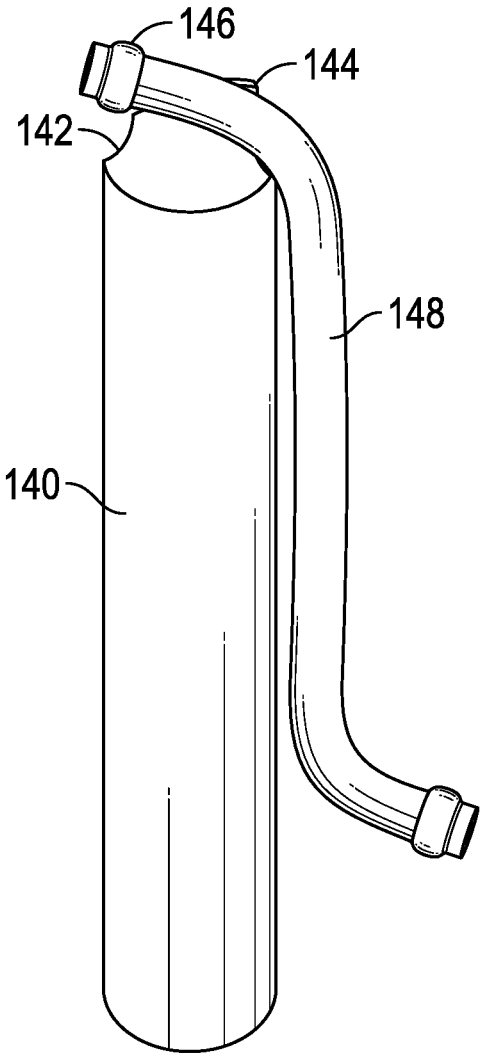
FIG. 14 illustrates an inner member and cord usable with the outer member shown in FIG. 13.

In some embodiments, as shown in FIGS. 13 and 14, the outer tube 130 can be formed with one or more bulges 132 formed along its length, from its closed end 136 to its open end 134. The inner tube 140 can have the cord 148 attached to an end 142 of the inner tube 140 with a retention device 144, such as a clip, for example. The cord 148 can run along side the inner tube 140. When the inner tube is placed into the outer tube 130, the cord 148 can fit into the bulge 132. The cord may connect to the open end 134 of the outer tube 130 by various manners, such as with a notch (not shown) as described above. In this embodiment, the inner tube 140 may be hollow or solid, as the cord does not run inside the inner tube 140, as in the previous example.

The device can be made from various materials, such as plastic, wood, metal, or the like. A handle or grip may be provided along the outer tube at one or more locations. Further, the foot 22 of the inner tube may be slip resistant so as not to slip during use.

To use the device, the user can stand next to the device and compress the device, with the device positioned in front of them, to their side, or various locations therebetween. The length of the tubes and the cord can vary to permit use in both a standing and a sitting position, for example. Further, different sized can permit compressing to be performed at various heights. For example, a user may need to reach up to compressing outer tube onto the inner tube, or the user may bend over to cause such a compression. In other embodiments, different grips may be provided to direct the user to different types of exercises that can be performed with the device of the present invention.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise device comprising:

an outer tube having a first end and an open second end, wherein a notch is formed in the open second end of the outer tube;

an inner tube having a first end fitting inside the open second end of the outer tube and a slot formed along a portion of the inner tube, the slot communicating an inside region of the inner tube with an exterior thereof; and an elastic cord secured to the first end of the inner tube and extending from the inside region of the inner tube through the slot, the elastic cord running inside the inner tube along at least the first end thereof, the elastic cord extending outward through the slot to terminate at the notch, wherein:

the elastic cord is operable to provide a resistance to compression of the inner tube into the outer tube, and there is only one outer tube, and the inner tube is configured to slide inside the outer tube against the resistance provided by the elastic cord from about 10 percent to about 100 percent of a length of the inner tube depending on a force applied by a user.

2. The exercise device of claim 1, wherein the notch has an opening formed in the open second end of the outer tube and a notch diameter larger than a width of the opening.

3. The exercise device of claim 2, wherein a thickness of the elastic cord is equal to or smaller than the opening, wherein the elastic cord is operable to be pushed through the opening into the notch.

4. The exercise device of claim 3, wherein the elastic cord includes a first expanded thickness region at a first end of the elastic cord, the first end of the elastic cord secured to the notch, wherein the first expanded thickness region prevents the elastic cord from being pulled through the notch diameter of the notch.

5. The exercise device of claim 4, wherein the elastic cord includes a second expanded thickness region operable to secure the elastic cord to the first end of the inner tube.

6. The exercise device of claim 5, further comprising a retaining ring attached to the first end of the inner tube, the retaining ring having an opening permitting the elastic cord to move therethrough while preventing the second expanded thickness region to move therethrough.

7. An exercise device comprising:

an outer tube having a first end and an open second end;

an inner tube having a first end fitting inside the open second end of the outer tube;

a slot formed along a portion of the inner tube, the slot communicating an inside region of the inner tube with an exterior thereof;

a notch formed in the open second end of the outer tube; and an elastic cord secured to the first end of the inner tube and extending from the inside region of the inner tube through the slot, the elastic cord running inside the inner tube along at least the first end thereof, the elastic cord extending outward through the slot to terminate at the notch, wherein:

there is only one outer tube, and the inner tube is configured to slide inside the outer tube against a resistance provided by the elastic cord from about 10 percent to about 100 percent of a length of the inner tube depending on a force applied by a user.

8. The exercise device of claim 7, wherein the notch has an opening formed in the open second end of the outer tube and a notch diameter larger than a width of the opening.

9. The exercise device of claim 8, wherein a thickness of the elastic cord is equal to or smaller than the opening when it is inserted into the opening, wherein the elastic cord is operable to be pushed through the opening into the notch.

10. The exercise device of claim 9, wherein the elastic cord includes a first expanded thickness region at a first end of the elastic cord, the first end of the elastic cord secured to the notch, wherein the first expanded thickness region prevents the elastic cord from being pulled through the notch diameter of the notch.

11. The exercise device of claim 10, wherein the elastic cord includes a second expanded thickness region operable to secure the elastic cord to the first end of the inner tube.

12. The exercise device of claim 11, further comprising a retaining ring attached to the first end of the inner tube, the retaining ring having an opening permitting the elastic cord to move therethrough while preventing the second expanded thickness region to move therethrough.

* * * * *